US005924938A

United States Patent [19]

Hines

[11] Patent Number: 5,924,938

[45] Date of Patent: Jul. 20, 1999

[54] GOLF PUTTER WITH MOVABLE SHAFT CONNECTION

[76] Inventor: James L. R. Hines, 1434 Tanglewood Rd., Abilene, Tex. 79605

[21] Appl. No.: 08/900,195

[22] Filed: Jul. 25, 1997

[51] Int. Cl.[6] ..... A63B 53/02; A63B 53/06

[52] U.S. Cl. ..... 473/307; 473/313; 473/333; 473/337; 473/341

[58] Field of Search ..... 473/340, 341, 473/313, 244, 246, 247, 248, 305, 307, 311, 342, 295, 296, 298, 299, 334, 335, 336, 337, 349, 350, 333

[56] References Cited

U.S. PATENT DOCUMENTS

| | | | |
|---|---|---|---|
| 556,042 | 3/1896 | Briggs | 473/305 |
| 2,592,731 | 4/1952 | Curley | 473/333 |
| 2,932,515 | 4/1960 | May | 473/248 |
| 3,397,888 | 8/1968 | Springer | 473/248 |
| 3,589,731 | 6/1971 | Chancellor | 473/333 |
| 4,121,832 | 10/1978 | Ebbing . | |
| 5,116,047 | 5/1992 | Phelan et al. . | |
| 5,121,922 | 6/1992 | Harsh | 473/333 |
| 5,299,807 | 4/1994 | Hutin | 473/329 |
| 5,385,348 | 1/1995 | Wargo . | |
| 5,388,827 | 2/1995 | Reynolds, Jr. . | |
| 5,407,196 | 4/1995 | Busnardo . | |
| 5,415,399 | 5/1995 | Kettelson . | |
| 5,423,535 | 6/1995 | Shaw | 473/291 |
| 5,429,356 | 7/1995 | Dingle et al. . | |
| 5,437,447 | 8/1995 | Rigutto | 473/251 |
| 5,439,222 | 8/1995 | Kranenberg | 473/309 |
| 5,482,282 | 1/1996 | Willis | 473/342 |
| 5,524,331 | 6/1996 | Pond | 29/527.4 |
| 5,531,445 | 7/1996 | Levocz et al. | 473/341 |
| 5,533,730 | 7/1996 | Ruvang | 473/251 |
| 5,542,666 | 8/1996 | Chou | 473/314 |
| 5,632,694 | 5/1997 | Lee | 473/336 |

*Primary Examiner*—Steven Wong
*Assistant Examiner*—Stephen L. Blau
*Attorney, Agent, or Firm*—Jacobson, Price, Holman & Stern, PLLC

[57] ABSTRACT

A golf putter includes a club head and an upstanding shaft having a lower hosel end removably supported on the club head. Structure is provided for selectively locating the hosel in multiple selected positions spaced apart in front-to-rear and transversely extending paths on the club head, as well as structure for selective weighting of the club head both forward and rearward of the selected hosel position on the club head. Further structure is provided for selective spring biased live weighting of the club head and still further structure is provided for selective additional dead weighting of the club head laterally of the shaft hosel portion. Also, structure is provided enabling conversion of the club from right hand use to left hand use and each of the above noted adjustments require only the use of simple hand tools and not more than minimal time to effect, although each adjustment to be made requires the removal of at least nine parts thereby rendering it difficult for a golfer to make illegal adjustments to his putter while playing a golf course.

16 Claims, 6 Drawing Sheets

GOLF PUTTER WITH MOVABLE SHAFT CONNECTION

CROSS-REFERENCE TO RELATED APPLICATIONS

Not Applicable

STATEMENT REGARDING FEDERAL SPONSORED RESEARCH OR DEVELOPMENT

Not Applicable

BACKGROUND OF THE INVENTION

1. Field of the Invention

This invention relates generally to a golf putter and, in particular, to a golf putter which can be adjusted to selectively locate the hosel portion of the club shaft at various positions on the putter head, and for both right hand and left hand use and to selectively establish a desired weighting for the club head.

2. Description of Related Art

Various different adjustable golf clubs including golf putters have been provided to allow changes in the loft of the ball striking face of the club head, "live" and "dead" weighting of the club head, variations in the angle of the club shaft relative to the club head, variable weighting of the club head both laterally and longitudinally of the club head and conversion of the club from right hand to left hand play.

U.S. Pat. No. 4,121,832 to Raymond A. Ebbing discloses a golf putter including a variably configurable club head provided with a demountable striker insert assembly which may be variously weighted and mounted to the club head in a manner to vary the loft of the ball striking face of the club and convert the club from right hand to left hand operation. U.S. Pat. No. 5,385,348 to Elmer Wargo discloses a golf club head constructed to receive one or more replaceable weight inserts spaced along the club head from the heel portion to the toe portion thereof and also the use of loose "free weights" contained within a weight insert.

U.S. Pat. No. 5,388,827 to Walker Reynolds, Jr. discloses a golf putter shaft-to-head attachment which allows the shaft to be replaced by a shorter or longer shaft of lesser or greater weight and a putter head whose weight may be increased or decreased and varied laterally of the club head. U.S. Pat. No. 5,407,196 to Romoldo Busnardo discloses a putter head which is adjustable from left to right handed operation, from a positive loft to a negative loft of the striking face and as to the angle of inclination at which the club shaft and attached hosel intersects with the head. U.S. Pat. No. 5,415,399 to Russell W. Kettelson also discloses a golf putter shaft-to-head attachment which allows the angle of the shaft with respect to the putter head to be adjusted and also an adjustable length shaft.

U.S. Pat. No. 5,116,047 to Herbert A. Phelan et al. discloses a golf putter adapted to form a left handed putter or a right handed putter and a putter head which may be variously weighted. U.S. Pat. No. 5,429,356 to Craig D. Dingle et al. discloses a golf putter which may be variably weighted transversely and which enables adjustment of the angle of the shaft relative to the club head. U.S. Pat. No. 5,531,445 to Reynold J. Levocz et al. discloses an adjustable shaft-to-head connection for a golf putter whereby the angle of the shaft may be adjusted relative to the head. U.S. Pat. No. 5,542,666 to Arthur C. P. Chan discloses a golf club having a transitional hosel portion which is insertable for temporary engagement in the head of the club and the shaft to permit selecting varying offsets and insets. U.S. Pat. No. 5,533,730 to John A. Ruvang discloses a golf putter providing configurable characteristics of striking face-to-shaft lateral alignment, center of gravity, shaft-to-head longitudinal alignment, head-to-shaft angle, total weight, weight distribution, and targeting.

SUMMARY OF THE INVENTION

In the game of golf, putting is one of the more difficult aspects of the game. "Reading" a green must be carried out under all course and weather conditions. Some golfers are very apt at reading greens while others have difficulty in doing so.

A golfer who is very familiar with his favorite putter has a better chance of properly reading a green than a golfer who has less experience with his putter. However, a golfer's instant attitude, level of concentration, expertise and awareness often has an effect on his putting ability, as do course and weather conditions. In addition, a golfer sometimes will experience swings in his or her putting ability which are problematical and difficult to moderate and solve.

The golf club of the instant invention has been specifically designed to help a golfer overcome such problems when practicing on a putting green prior to playing the course. The putter of the instant invention may be adjusted for right or left hand use, the shaft may be changed as to offset and/or length, the point of attachment of the hosel portion of the shaft to the head may be varied to allow a change in position of hands relative to the center of the putter face in the front-to-rear direction as well as the lateral direction. Such change in position of the hands allows a change in body positioning relative to the center of the putter face and further allows the center of inertia at the hosel portion of the shaft to be varied laterally of the center of the putter face. In addition, total "dead weighting" of the putter head of the instant invention may be varied as well as front and rear "dead" weighting of the club head independent of total weighting of the club head. Still further, lateral "dead" weighting of the club head can be varied and "live" inertia weighting of the club head may be effected and adjusted both as to the amount of inertia weighting provided and time delay of effectiveness of inertia weighting.

A golf putter in accordance with the present invention includes (1) structure for selectively locating the hosel portion of the club shaft in selected positions spaced apart in front-to-rear, longitudinally extending paths as well as transversely spaced paths on the club head, (2) structure for selective weighting of the club head both forward and rearward of the selected hosel portion position on the club head, (3) structure for selective spring biased live weighting of the club head, (4) structure for selective additional "dead weighting" of the club head laterally of the position of shaft hosel portion, and (5) structure enabling conversion of the club from right hand to left hand use, the above five available adjustments each requiring only the use of simple hand tools and not more than minimal time to effect. Thus, a golfer, when practicing putting shots on a putting green, may adjust his putter to the best performance level possible for that particular golf course under given green and weather conditions.

It is a further aspect of this invention that all of the above noted adjustments to the club may be made with simple hand tools. However, the adjustments are not susceptible to completion in an extremely short period of time since each adjustment requires the removal of at least nine parts. Thus, a golfer can make the adjustments deemed necessary when practicing putting on a putting green, but the complexity of the adjustments discourages a golfer from making any illegal adjustments to his putter during actual play of a round of golf.

Accordingly, it is an object of this invention to provide a golf putter which may be adjusted as to many of the playing aspects of this club according to the desires of the golfer on any particular day and for any green and weather conditions.

Another object of this invention is to provide a golf putter which may be readily adjusted between right and left hand play.

A further object of this invention is to provide a golf putter constructed in a manner such that shafts of different lengths and offsets may be variously positioned over the plan area of the head of the putter.

A still further object of this invention is to provide a golf putter whose head may be adjusted as to overall weight, variances in front-to-rear weighting as well as transverse or lateral weighting.

Yet another object of this invention is to provide a putter head which is "live" inertia weighted and includes structure whereby the amount of inertia weighting may be varied as well as the time delay of effectiveness of such inertia weighting.

A final object of this invention to be specifically enumerated herein is to provide a golf putter in accordance with the preceding objects and which will conform to conventual forms of manufacture, be of simple construction and relatively easy to adjust so as to provide a device that will be economically feasible and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
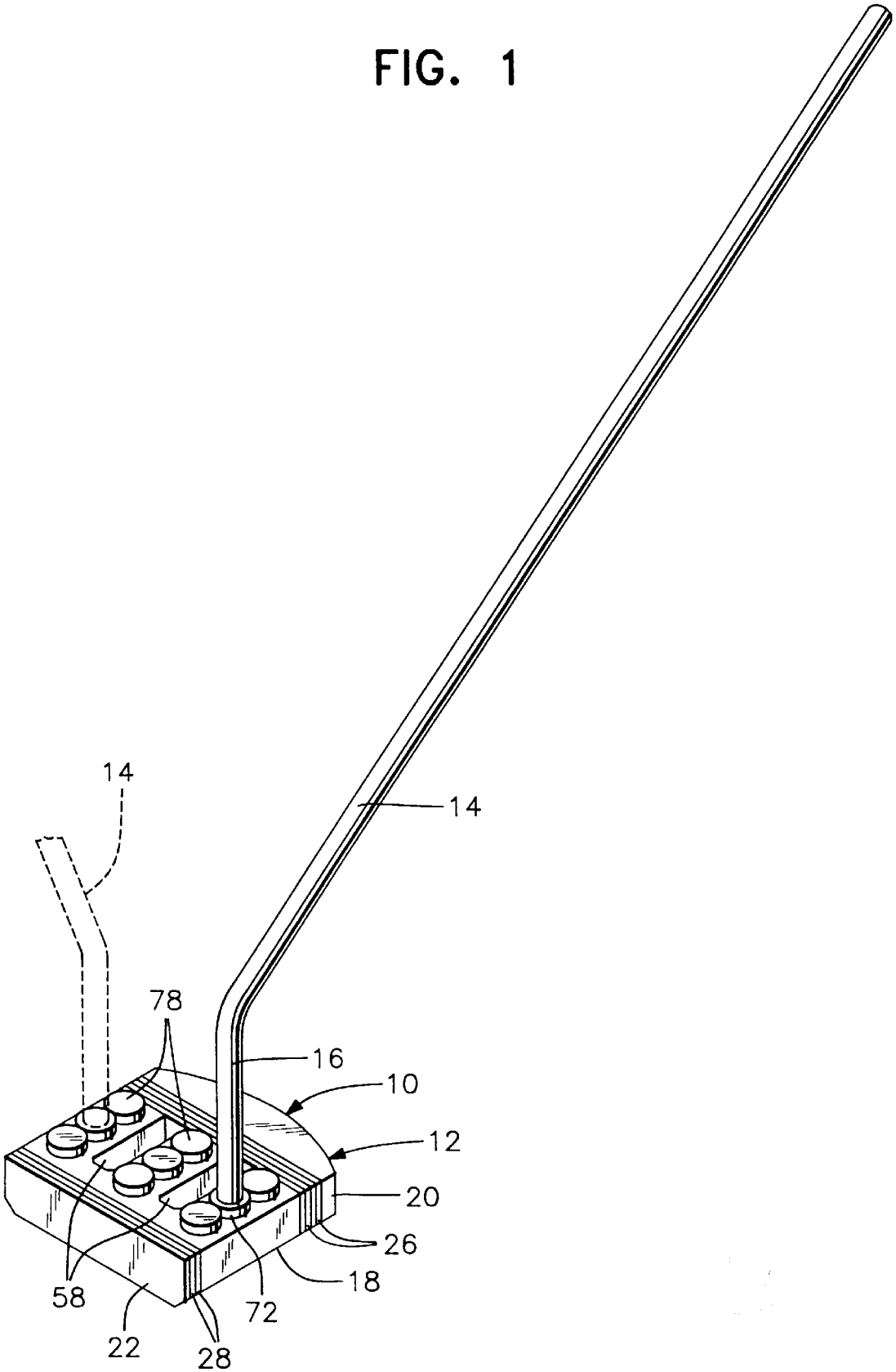
FIG. 1 is a perspective view of the preferred form of golf club constructed in accordance with the present invention illustrating a selected positional mounting of an offset type of shaft on the head of the club for right hand use and fragmentarily illustrating the shaft in phantom lines positioned for left hand operation.

In describing the preferred embodiments of the present invention as illustrated in the drawings, specific terminology will be resorted to for the sake of clarity. However, the invention is not intended to be limited to the specific embodiment illustrated and terms so selected; it being understood that each specific term includes all technical equivalents which operate in a similar manner to accomplish a similar purpose.

Referring now specifically to FIGS. 1, 2, 4 and 12–16 of the drawings, the numeral 10 generally designates a first preferred form of putter constructed in accordance with the present invention including a head assembly generally designated by the numeral 12 and a shaft 14 having an offset lower hosel portion 16. The head assembly 12 includes a head body referred to generally by the reference numeral 18, a rear plate 20, a front plate 22, a bottom plate 24, front rear weight plates 26 and rear front weight plates 28.

Figure 2:
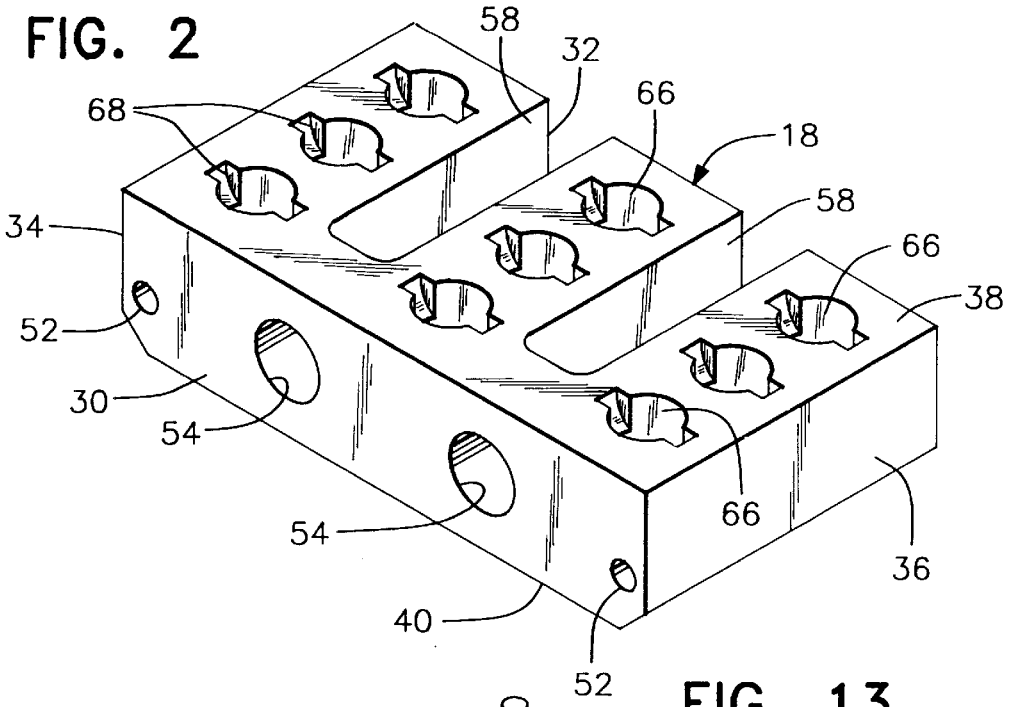
FIG. 2 is a perspective view of the body of the club head of the putter shown in FIG. 1.
Figure 13:
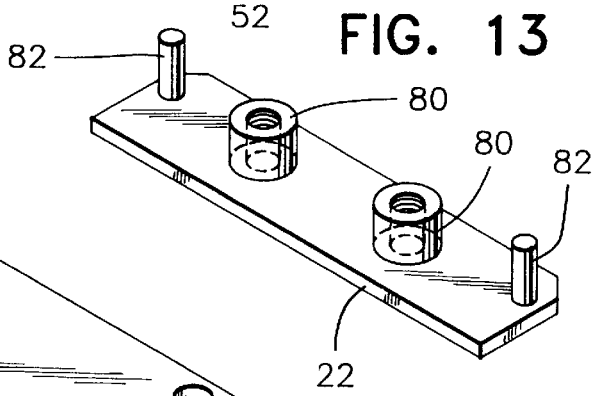
FIG. 13 is a perspective view of the face plate of the club head of the putter in FIG. 1.
Figure 14:
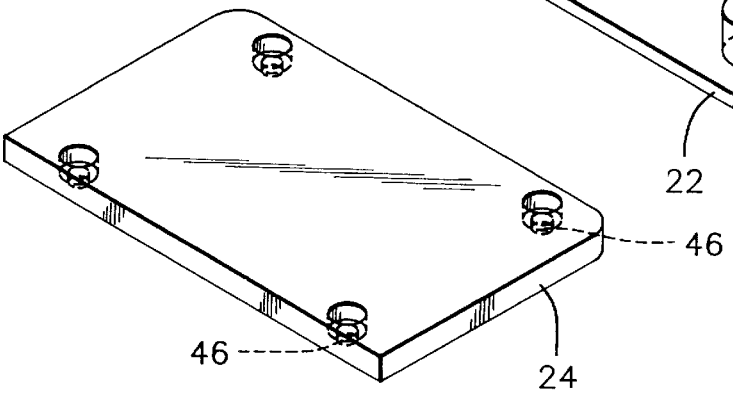
FIG. 14 is a perspective view of the bottom cover plate of the club head of the putter in FIG. 1.
Figure 15:
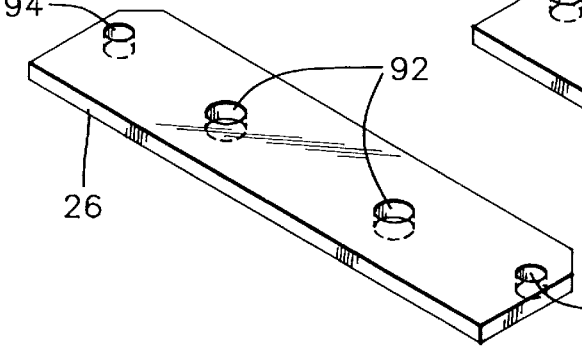
FIG. 15 is a perspective view of one of the forward weight plates of the club head of the putter in FIG. 1.
Figure 16:
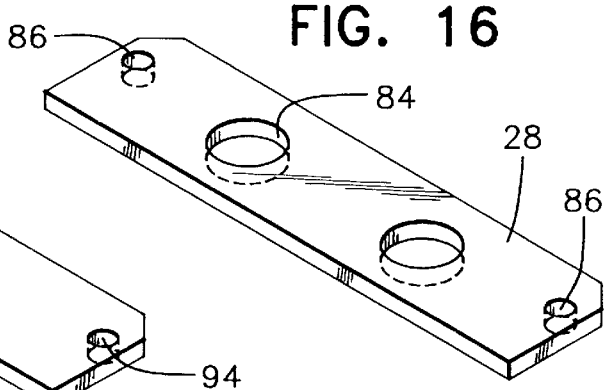
FIG. 16 is a perspective view of one of the rear weight plates of the club head of the putter in FIG. 1.

As shown in FIG. 2, the head body 18 includes front and rear faces 30 and 32, opposite side faces 34 and 36 and top and bottom faces 38 and 40. In addition, the underside of the head body 18 includes a recess 42 formed therein, see FIG. 4, which opens downwardly through the bottom face 40, and the bottom plate 24 has four counter bore equipped bores 46 formed therein, see FIG. 14, through which headed fasteners 48 may be passed and threaded into threaded blind bores 50, see FIG. 4, formed in the head body 18 to secure the bottom plate 24 to the underside of the head body 18.

Figure 5:
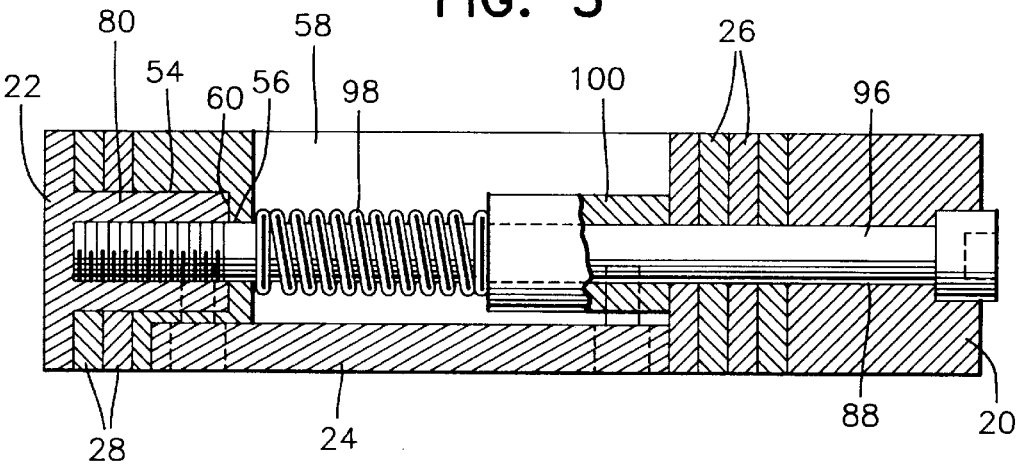
FIG. 5 is an enlarged fragmentary vertical sectional view taken substantially upon the plane indicated by the section line 5–5 of FIG. 3.
Figure 6:
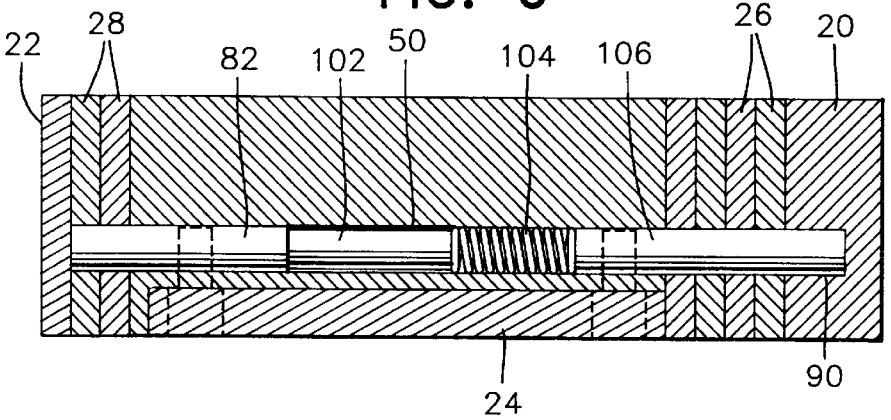
FIG. 6 is an enlarged fragmentary vertical sectional view taken substantially upon the plane indicated by the section line 6–6 of FIG. 3.

The head body 18 includes a pair of side horizontal bores 52 formed therethrough extending in a front-to-rear direction on each side of the body 18, as well as a pair of larger central bores 54 formed therethrough. The rear ends of the bores 54 terminate at reduced diameter bores 56, see FIG. 5, opening rearwardly into the forward ends of a pair of rearwardly opening recesses 58 formed vertically through the head body 18. The forward end of recesses 58 form forwardly facing shoulders 60 at the rear ends of the central bores 54, as shown in FIG. 5.

Figure 1A:
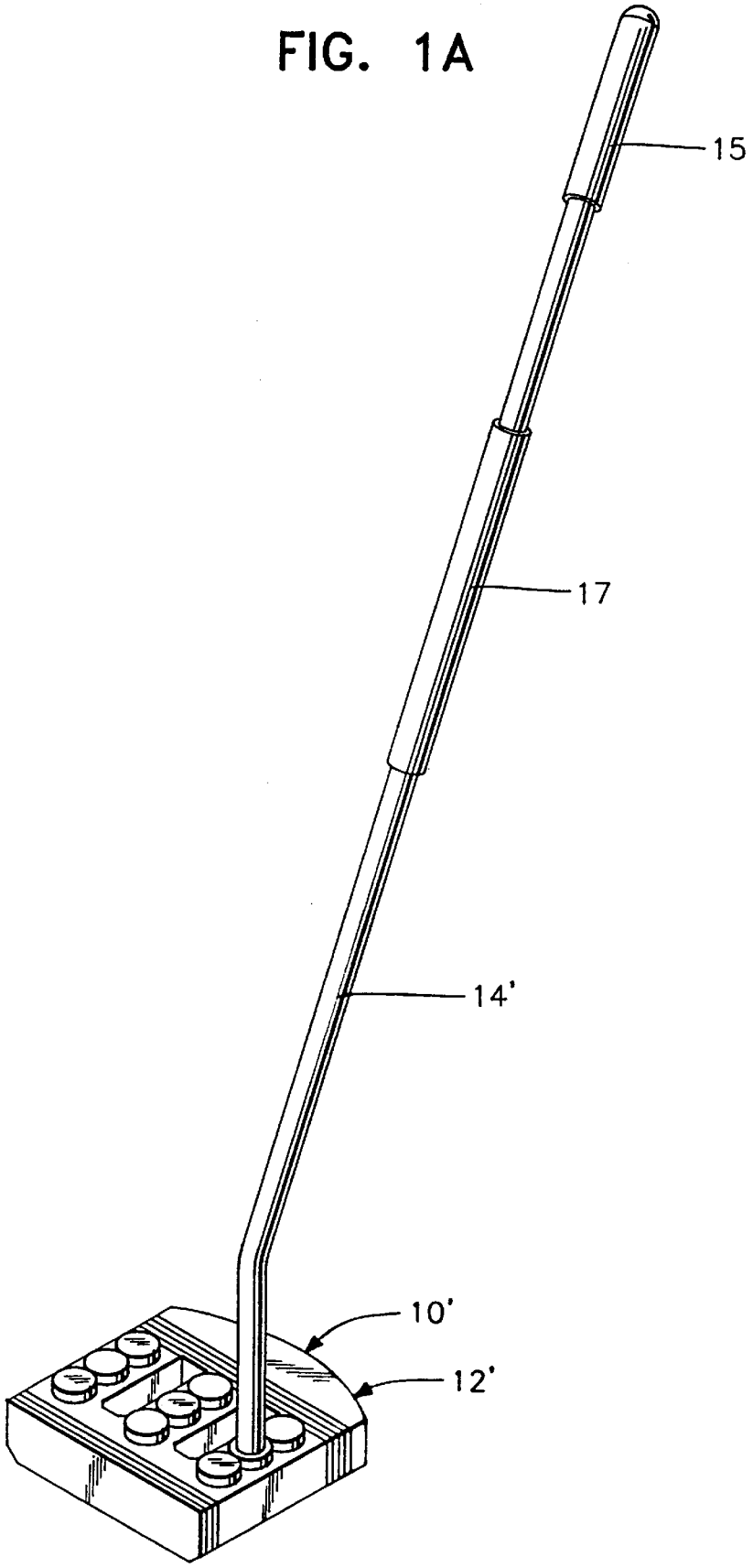
FIG. 1A is a perspective view similar to FIG. 1 but illustrating the putter equipped with a longer shaft adapted for spaced two handed usage.
Figure 3:
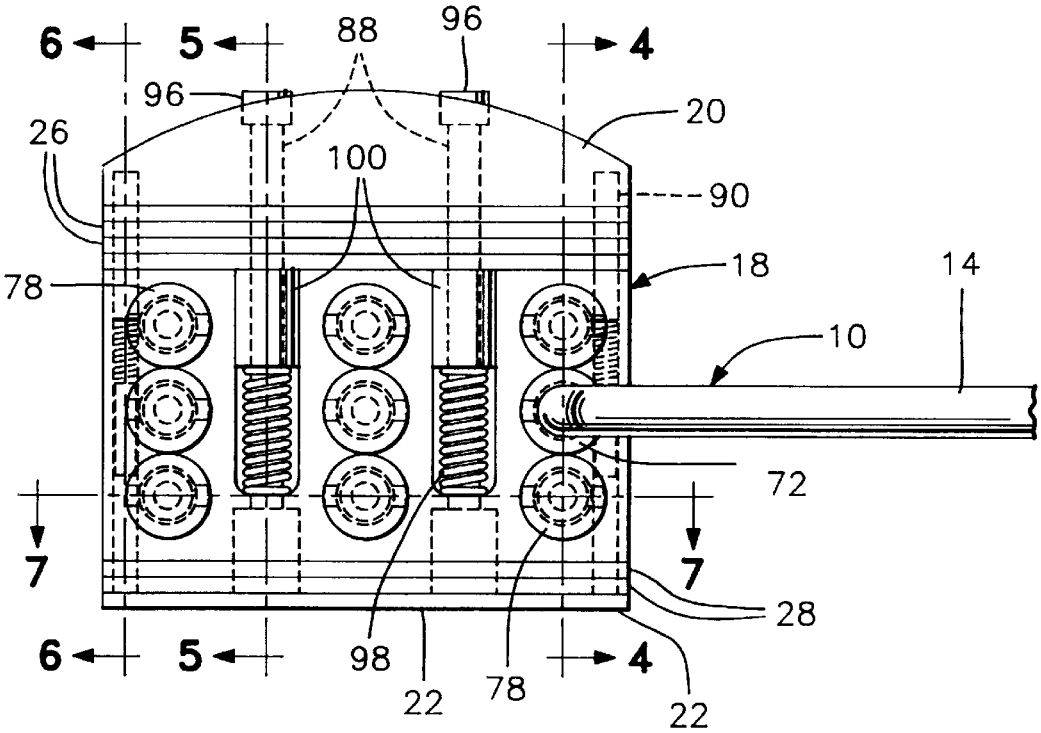
FIG. 3 is a top plan view of the putter illustrated in FIG. 1 with the upper portion of the shaft broken away.
Figure 4:
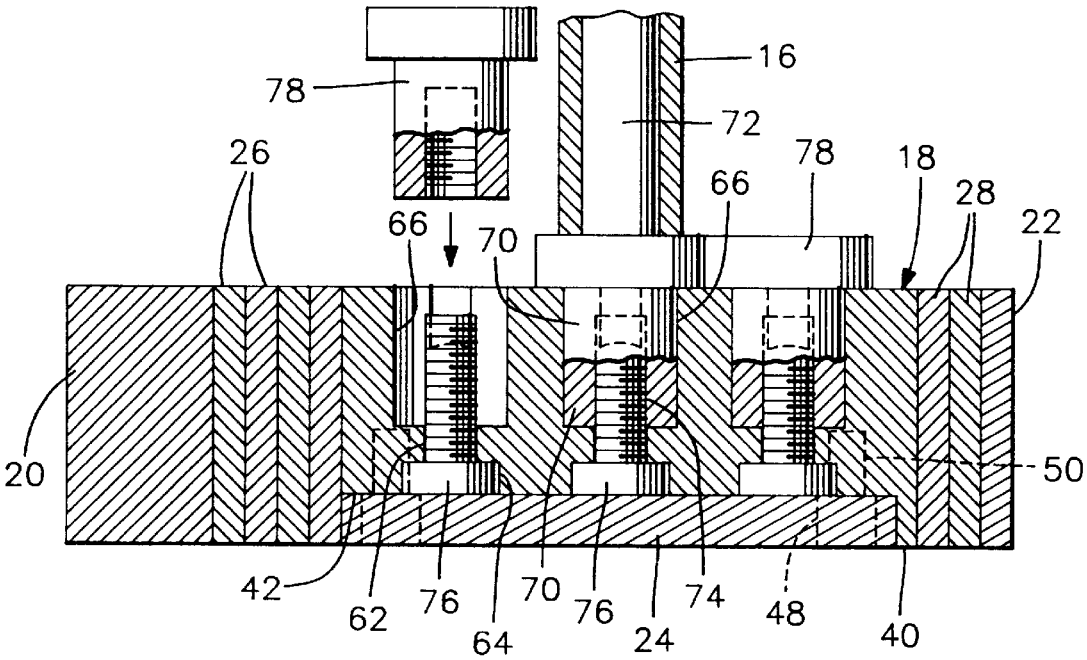
FIG. 4 is an enlarged vertical sectional view taken substantially upon the plane indicated by the section line 4—4 of FIG. 3 and with one of the shaft socket plugs illustrated in exploded position.
Figure 7:
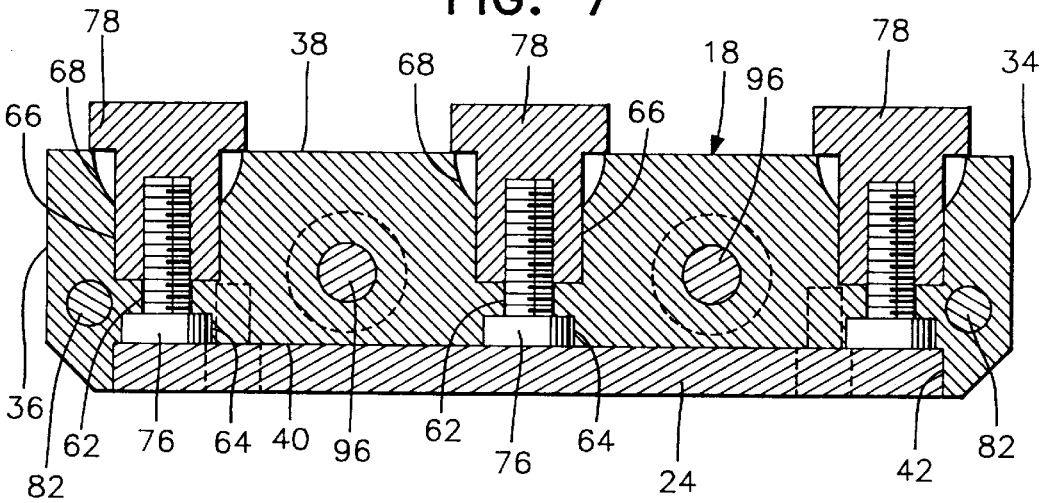
FIG. 7 is an enlarged fragmentary vertical sectional view taken substantially upon the plane indicated by the section line 7–7 of FIG. 3.
Figure 8:
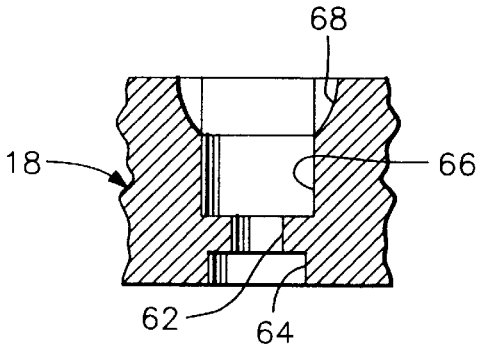
FIG. 8 is an enlarged fragmentary vertical sectional view of the head body illustrating a first form of shaft hosel receiving socket in accordance with the present invention.
Figure 10:
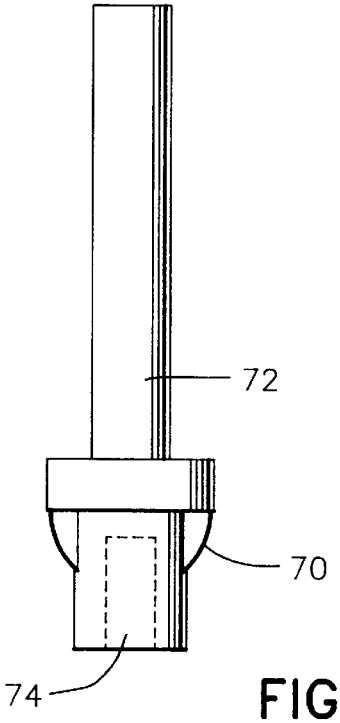
FIG. 10 is a side elevational view of a hosel to be removably anchored in the lower hosel portion of the club shaft and adapted to be received in the socket illustrated in FIG. 8.
Figure 11:
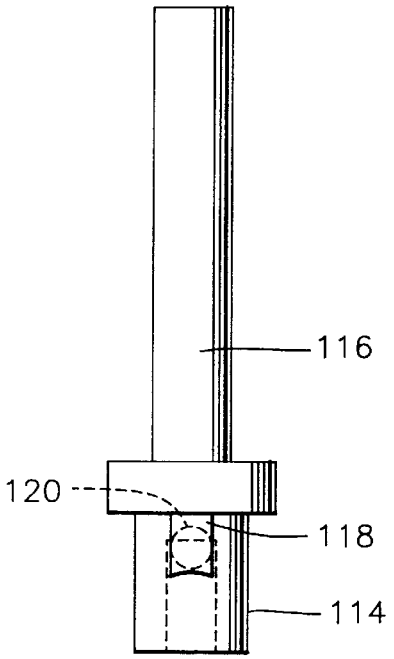
FIG. 11 is a side elevational view of a second form of hosel adapted to be received in the socket illustrated in FIG. 9.
Figure 12:
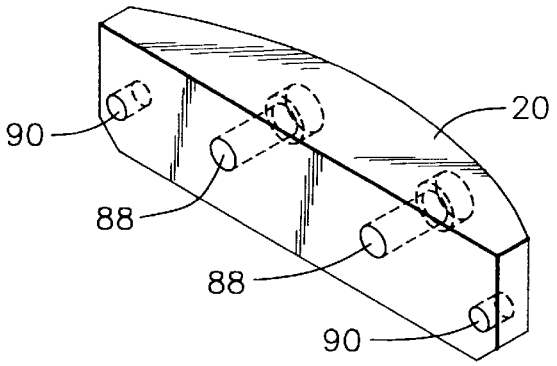
FIG. 12 is a perspective view of the rear plate of the club head of the putter in FIG. 1.

The head body 18 has three laterally spaced front-to-rear longitudinally extending rows of three bores 62 each formed substantially vertically therethrough, see FIGS. 4 and 7. The lower ends of the bores 62 include lower counter bores 64 while the upper ends of the bores 62 include upper counter bores 66. The counter bores 66 are each machined at 68, see FIGS. 2 and 8, as though to receive a half moon key, but this machining is designed to receive, in conjunction with the counter bore 66, the matching lower lug equipped plug end 70 of a hosel 72, as illustrated in FIG. 10. The lower end of the plug end 70 is provided with a threaded blind bore 74, and a headed fastener 76 is utilized to removably secure the plug end 70 into its associated counter bore 66, see FIG. 4. The upper end of the hosel 72 is permanently secured in the lower hosel portion end 16 of the shaft 14 in any known convenient manner. The other counter bores 66 which do not receive hosel 72 each has a plug 78 secured therein by a corresponding fastener 76, as shown in FIGS. 1, 1A and 3.

With reference again to FIGS. 2 and 10, it will be noted that the hosel 72 may be secured within any one of the nine machined counter bores 66, in either of two positions rotated 180° relative to each other. Thus, the putter 10 may be adjusted for either right hand play or left hand play as the shaft positions illustrated in solid and phantom lines indicate in FIG. 1. Further, the shaft 14 can be located in any of the nine different positions spaced longitudinally and transversely of the putter head by positioning the lower end of the plug end 70 of hosel 72 in the desired bore 66 and securely fastening the end 70 therein with fastener 76.

With attention now invited more specifically to FIGS. 2, 5, 6 and 12–16, the front plate 22 includes a pair of rearwardly projecting threaded blind bore equipped cylindrical projections 80 and a pair of rearwardly projecting positioning pins 82. The front plate 22 is registered with the front face 30 of the head body 18 and typically has two of the front weight plates 28 mounted on the projections 80 and positioning pins 82 forward of the front face 30. The weight plates 28 include large and small bores 84 and 86 formed therethrough to receive the projections 80 and the positioning pins 82. The projections 80 and positioning pins 82 project rearwardly of the plates 28 and are telescopically received snugly in the counter bores 54 and horizontal bores 52.

The rear plate 20 has a pair of counter bore equipped bores 88 formed therethrough as well as a pair of smaller diameter forwardly opening blind bores 90 formed therein. The rear plate is disposed rearward of the rear face 32 of the head body 18, and four of the rear weight plates 26 are typically interposed between the rear plate 20 and the rear face 32 of the head body 18. The rear weight plates 26 include pairs of large and small diameter bores 92 and 94 formed therethrough for registration with the bores 88 and 90. A pair of through bolts 96 are provided and passed through the bores 88 formed in the rear plate 20 as well as the bores 92 formed in the weight plates 26. The through bolts 96 extend forwardly through the recesses 58, through the bores 56 and are threaded into the threaded counter bore equipped projections 80 on the front plate 22, see FIG. 5.

In addition, each of the through bolts 96 preferably has a forward compression spring 98 loosely disposed thereon as well as a sleeve-type inertia weight 100 disposed thereon rearward of the spring 98, each spring 98 and inertia weight 100 set being disposed in one of the recesses 58. Further, each of the horizontal bores 52 includes a cylindrical dead weight 102 disposed therein rearward of and abutting the corresponding positioning pin 82, see FIG. 6, and a compression spring 104 is disposed in each bore 52 rearward of the corresponding dead weight 102. Also, a positioning pin 106 is provided for each bore 52 and corresponding blind bore 90. The front end of each positioning pin 106 is disposed in the rear end of the corresponding bore 52, and the rear end of each positioning pin 106 is bottomed in the corresponding forwardly opening blind bore 90 of the rear plate 20. Hence, the intermediate length portion of each positioning pin 106 is received through the bores 94 formed in the corresponding rear weight plates 26 and holds the rear weight plates in position, see FIG. 6.

The fasteners 76 which retain the lower plug end 70 of the hosel 72 in its counter bore 66, and also the plugs 78 in the remaining counter bores 66, are completely enclosed by the removable bottom plate 24. In addition, if desired, a smaller pair of cover plates (not shown) could be provided for and secured over the upper sides of the recesses 58, or the head body 18 could be drilled rather than cut out, in order that the springs 98 and inertia weights 100 may also be fully enclosed.

Figure 9:
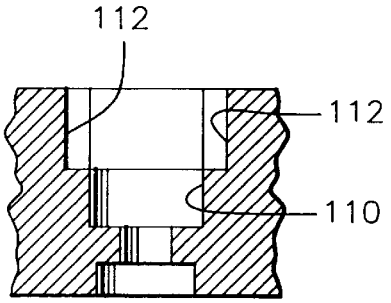
FIG. 9 is an enlarged vertical sectional view similar to FIG. 8 but illustrating a second form of shaft hosel receiving socket.

With attention now invited more specifically to FIGS. 8–11, it may be seen that the machining of the counter bore 66 as at 68 may be slightly altered in the manner illustrated in conjunction with an alternate form of counter bore 110 illustrated in FIG. 9. The machining at 112 in the counter bore 110 enables the modified form of plug end 114 illustrated on the hosel 116 in FIG. 11 to be locked in either of two 180° rotated positions within the counter bore 110. The plug end 114 includes diametrically opposite lugs 118 which are received in the diametrically opposite machined areas 112 of the counter bore 110. Also, as shown in phantom lines, the 180° opposite lugs 118 may be substituted for by a roll pin 120 or the like.

With attention now invited more specifically to FIG. 1A, the reference numeral 10' generally illustrates a second preferred form of putter whose head assembly 12' is identical to the head assembly 12 previously described. The shaft 14' of the putter 10' is, however, different in that it is slightly longer than the shaft 14 and includes longitudinally spaced upper and lower hand grips 15 and 17 for use by a golfer who wishes to place his or her hands in spaced positions along a putter shaft.

In operation, either the shaft 14 or the shaft 14' may have its plug end of the hosel thereof removably secured in a selected counter bore 66 merely by removing the bottom plate 24, and removing the fastener 76 and associated plug 78. Then, the plug end 70 of the shaft may be secured in the selected counter bore 66 through utilization of the fastener 76, after which the bottom plate 24 is resecured in position closing the recess 42. Of course, either the shaft 14 or the shaft 14' may be secured in one of two 180° relatively rotated positions in order to define either a left hand club or a right hand club.

If during putting practice on a putting green the user of either the putter 10 or 10' wishes to shift the hosel of the shaft to one of the eight other positions defined by the counter bores 66, repositioning of the club hosel may be effected in the same manner above described with regard to mounting of the club hosel to the head assembly 12. However, once the plug 78 has been removed from the new location of the shaft hosel and the shaft hosel has been installed in that new location, the removed plug is then reinstalled in the counter bore 66 from which the club hosel was removed. The bottom plate 24 is then reinstalled.

Repositioning the shaft hosel relative to the head assembly 12 is effective to change the position of the hands relative to the center of the putter face both in a front-to-rear longitudinal direction as well as in a lateral direction, depending upon the new positioning of the shaft hosel in relation to the old positioning of the shaft hosel. In addition, repositioning of the shaft hosel relative to the head assembly 12 allows the golfer to reposition his body relative to the center of the club face and further allows the center of inertia at the hosel position of the shaft to be adjusted laterally of the center of the putter face as well as in a longitudinal direction relative to the putter face.

The total weight of the head assembly may be varied by adding or subtracting one or more of the plates 26 and 28. Further, the plates 26 and 28 are preferably of about the same weight so that the longitudinal weighting of the head assembly 12 may be adjusted independently of the total weight of the head assembly by adding and/or subtracting one or more of the plates 26 and subtracting and/or adding a corresponding number of plates 28. To remove or add plates 26 and 28 the through bolts 96 are temporarily removed and the desired plates 26 and 28 may be added or removed, as desired before reinstalling the through bolts 96.

In addition, when the through bolts 96 have been removed, the coil springs 98 may be replaced by coil springs having different tension ratings or lengths and the inertia weights 100 may be replaced by weights which are either heavier or lighter and which are longer or shorter. If the springs 98 have high tension ratings, the "live" inertia weights 100 will function substantially as dead weights, merely as though adding weight to the head assembly 12. However, if the weight value of the weights 100 is increased and/or the tension of the springs 98 is reduced, the inertia weights 100 will act as "live" weights and momentarily delay their inertia action during a putting stroke until slightly after initial contact of the face plate 22 with a golf ball. Accordingly, the head assembly 12 may be adapted for use on fast or slow greens.

In addition to repositioning of the shaft hosel transversely of the head body 18 in order to laterally shift the center of inertia of the head assembly 12 relative to the shaft hosel, when the through bolts 96 have been removed, one or both of the dead weights 102 may be exchanged for longer or shorter dead weights of the same type. In this manner, lateral shifting of the center of inertia of the head assembly 12 relative to the center of the face plate 22 may be finally adjusted.

It is pointed out that substantially all of the possible adjustments with regard to the weighting of the head assembly 12 and positioning of the shaft hosel relative to the head assembly 12 for the putter of this invention may be carried out by a golfer while using simple hand tools and without a great expenditure of time. However, all of these adjustments require the disassembly of at least nine parts of the club, thus discouraging any club adjustment during course play. However, when practicing on a putting green, after several practice putts have been made, relatively simple adjustments to the club as hereinabove described may be made in order to finally adjust the performance of the club to course and weather conditions and also the instant attitude and level of concentration, expertise and awareness of the golfer.

Further, while the golf putter of the present invention has been disclosed with the numerous adjustment features available from this invention, including selectively locating the hosel portion of the club shaft in nine selected positions, selective weighting of the club head by weight plates positioned adjacent the front and rear of the club head, selective spring biased live and dead weighting of the club head, any one or more of these features can be omitted without departing from the purpose and scope of this invention. For example, less or more than nine selective positions can be provided for placement of the hosel and putter shaft on the club head and one or more of the weighting systems could be modified or omitted.

Finally, the foregoing should be considered as illustrative only of the principles of the invention. Since numerous modifications and changes readily will occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A golf club which comprises a head body including opposite lateral sides, structure defining a forward ball striking surface, an upper surface and a bottom surface, and a plurality of side-to-side spaced rows of front-to-rear spaced recesses formed therein and opening upwardly through said upper surface, an upstanding shaft including a lower end removably receivable downwardly in a selected one of said recesses, said head body including a cavity formed therein opening downwardly through said bottom surface and said recesses opening downwardly through said cavity, and fastener means removably received upwardly in said cavity and removably engaged with and anchoring said lower end in said selected one recess.

2. The golf club of claim 1 including a cover plate removably secured to said head body and closing said cavity from below.

3. The golf club of claim 1 wherein said plurality of recesses include three side-to-side spaced front-to-rear extending rows of spaced recesses opening upwardly through said upper surface.

4. The golf club of claim 3 wherein each of said rows of recesses includes three recesses.

5. The golf club of claim 1 wherein said structure defining said ball striking surface is defined by a forward face plate removably supported from said head body, and a rear plate removably supported from said head body.

6. The golf club of claim 5 including at least one removable front weight plate interposed between said face plate and said head body and at least one removable rear weight plate interposed between said head body and said rear plate.

7. The golf club of claim 6 including elongated, headed threaded fasteners abutted against and slidingly passing through said rear plate, said rear weight plate, said head body and said front weight plate, said threaded fasteners being threaded into rearwardly projecting threaded bore equipped anchor bosses carried by said face plate and rearwardly slidably received through said front weight plate.

8. The golf club of claim 7 wherein said head body includes a plurality of laterally spaced rearwardly opening recesses formed therein through which said threaded fasteners extend, said recesses terminating forwardly at front-to-rear extending bores opening forwardly through said head body, compression springs forwardly seated in said rearwardly opening recesses and tubular weights slidable in said rearwardly opening recesses rearward of said springs, said fasteners being slidably received through said tubular weights, compression springs and bores.

9. The golf club of claim 8 wherein said head body includes opposite lateral side front-to-rear extending passages formed therein, a weight body removably slidable in and forwardly seated in each of said passages, the rear ends of said passages having compression springs disposed therein behind said weight bodies.

10. The golf club of claim 1 including closure means removably closing each of said recesses, except said one recess, from above.

11. The golf club of claim 10 wherein said ball striking surface is defined by a forward face plate removably supported from said head body, said head body including a rear plate removably supported therefrom, at least one removable front weight plate interposed between said face plate and said head body and at least one removable rear weight plate interposed between said head body and rear plate.

12. The golf club of claim 1 wherein said lower end and each of said recesses includes means operative to anchor said lower end to said head body in predetermined opposite 180° rotated positions relative to said head body.

13. A golf club head assembly comprising a head body including structure defining a forward ball striking surface, an upper surface and a bottom surface, said ball striking surface being defined by a forward face plate removably supported from said head body, a rear plate removably supported from said head body, at least one removable front weight plate interposed between said face plate and said head body and at least one removable rear weight plate interposed between said head body and said rear plate, a plurality of removable fasteners slidable through said head body and weight plates and tensioned between said face and rear plates.

14. A golf club head assembly comprising a head body including an upper surface and a bottom surface, a forward face plate and a rear plate removably supported from said head body, at least one removable front weight plate interposed between said face plate and said head body and at least one removable rear weight plate interposed between said head body and said rear plate, elongated, threaded fasteners abutted against and slidingly passing through said rear plate, said rear weight plate, said head body and said front weight plate, said threaded fasteners being threaded into rearwardly projecting threaded bore equipped anchor bosses carried by said face plate and rearwardly slidably received through said front weight plate.

15. The golf club of claim 14 wherein said head body includes a plurality of laterally spaced rearwardly opening recesses formed therein through which said threaded fasteners extend, said recesses terminating forwardly at front-to-rear extending bores opening forwardly through said head body, compression springs forwardly seated in said rearwardly opening recesses and tubular weights slidable in said rearwardly opening recesses rearward of said springs, said fasteners being slidably received through said tubular weights, compression springs and bores.

16. The golf club of claim 15 wherein said head body includes opposite lateral side front-to-rear extending passages formed therein, a weight body removably slidable in and forwardly seated in each of said passages, the rear ends of said passages having compression springs disposed therein behind said weight bodies.

* * * * *